US005341063A

United States Patent [19]

Kumar

[11] Patent Number: 5,341,063

[45] Date of Patent: Aug. 23, 1994

[54] FIELD EMITTER WITH DIAMOND EMISSION TIPS

[75] Inventor: Nalin Kumar, Austin, Tex.

[73] Assignee: Microelectronics And Computer Technology Corporation, Austin, Tex.

[21] Appl. No.: 981,958

[22] Filed: Nov. 24, 1992

Related U.S. Application Data

[62] Division of Ser. No. 789,237, Nov. 7, 1991, Pat. No. 5,199,918.

[51] Int. Cl.[5] ..... H01J 1/02; H01J 1/14

[52] U.S. Cl. ..... 313/309; 313/355; 257/77

[58] Field of Search ..... 313/309, 336, 351, 355; 257/77; 315/169.3

[56] References Cited

U.S. PATENT DOCUMENTS

| | | | |
|---|---|---|---|
| 2,959,704 | 11/1960 | Snell, Jr. et al. | 313/309 |
| 3,894,332 | 7/1975 | Nathanson et al. | 313/336 |
| 3,947,716 | 3/1976 | Fraser, Jr. et al. | 313/336 |
| 3,970,887 | 7/1976 | Smith et al. | 313/309 |
| 3,998,678 | 12/1976 | Fukase et al. | 156/3 |
| 4,084,942 | 4/1978 | Villalobos | 51/307 |
| 4,139,773 | 2/1979 | Swanson | 250/423 |
| 4,164,680 | 8/1979 | Villalobos | 313/336 |
| 4,307,507 | 12/1981 | Gray et al. | 29/580 |
| 4,350,926 | 9/1982 | Shelton | 313/455 |
| 4,498,952 | 2/1985 | Christensen | 156/643 |
| 4,663,559 | 5/1987 | Christensen | 313/336 |
| 4,685,996 | 8/1987 | Busta et al. | 156/628 |
| 4,687,938 | 8/1987 | Tamura et al. | 250/423 |
| 4,855,636 | 8/1989 | Busta et al. | 313/306 |
| 4,933,108 | 6/1990 | Soredal | 252/518 |
| 4,943,343 | 7/1990 | Bardai et al. | 156/643 |
| 4,964,946 | 10/1990 | Gray et al. | 156/643 |
| 5,019,003 | 5/1991 | Chason | 445/24 |
| 5,129,850 | 7/1992 | Kane et al. | 445/508 |
| 5,138,237 | 8/1992 | Kane et al. | 315/349 |
| 5,141,460 | 8/1992 | Jaskie et al. | 445/508 |
| 5,180,591 | 1/1993 | Divorsky et al. | 313/355 X |

OTHER PUBLICATIONS

Maissel and Glang, *Handbook of Thin Film Technology*, 1983 Reissue, Chapters 8 and 10, McGraw-Hill, New York, N.Y.

Cade and Lee, "Vacuum Microelectronics", *GEC J. Res. Inc.*, Marconi Rev., 7(3), 129 (1990).

Geis et al., "Diamond Cold Cathode," *IEEE Electron Device Letters*, vol. 12, No. 8, Aug. 1991, pp. 456–459.

Geis et al, "Diamond Cold Cathodes," Applications of Diamond Films and Related Materials, Tzeng et al. (Editors), Elsevier Science Publishers B.V., 1991 pp. 309–310.

*Journal of Materials Research*, vol. 5, No. 11, Nov. 1990.

Noer, "Electron Field Emission from Broad-Area Electrodes", *Applied Physics* A 28, 1982, pp. 1–24.

Avakyan, et. al., "Angular Characteristics of the Radiation by Ultrarelativistic Electrons in Thick Diamond Single Crystals", *Soviet Technical Physics Letters*, vol. 11, No. 11, Nov. 1985, pp. 574–575.

Djubua, et al., "Emission Properties of Spindt-Type Cold Cathodes with Different Emission Cone Material", *iEEE Transactions on Electron Devices*, vol. 38, No. 10, Oct. 1991.

Wang, et. al., "Cold Field Emission from CVD Diamond Films Observed in Emission Electron Microscopy", *Electronics Letters*, vol. 27, No. 16, Aug. 1991.

*Primary Examiner*—Sandra L. O'Shea

*Attorney, Agent, or Firm*—David M. Sigmond; Michael Caywood

[57] ABSTRACT

A field emitter comprising a conductive metal and a diamond emission tip with negative electron affinity in ohmic contact with and protruding above the metal. The field emitter is fabricated by coating a substrate with an insulating diamond film having negative electron affinity and a top surface with spikes and valleys, depositing a conductive metal on the diamond film, and applying an etch to expose the spikes without exposing the valleys, thereby forming diamond emission tips which protrude a height above the conductive metal less than the mean free path of electrons in the diamond film.

28 Claims, 2 Drawing Sheets

FIELD EMITTER WITH DIAMOND EMISSION TIPS

CROSS-REFERENCE TO RELATED APPLICATIONS

This is a divisional of U.S. Ser. No. 07/789,237 filed Nov. 7, 1991 now U.S. Pat. No. 5,199,918.

BACKGROUND OF THE INVENTION

1. Field of the Invention

The invention relates to field emitters, and more particularly to a field emitter with diamond emission tips and method of making same.

2. Description of Related Art

Field emitters are widely used in ordinary and scanning electron microscopes since emission is affected by the adsorbed materials. Field emitters have also been found useful in flat panel displays and vacuum microelectronics applications. Cold cathode and field emission based flat panel displays have several advantages over other types of flat panel displays, including low power dissipation, high intensity and low projected cost. Thus, an improved field emitter and any process which reduces the complexity of fabricating field emitters is clearly useful.

The present invention can be better appreciated with an understanding of the related physics. General electron emission can be analogized to the ionization of a free atom. Prior to ionization, the energy of electrons in an atom is lower than electrons at rest in a vacuum. In order to ionize the atom, energy must be supplied to the electrons in the atom. That is, the atom fails to spontaneously emit electrons unless the electrons are provided with energy greater than or equal to the electrons at rest in the vacuum. Energy can be provided by numerous means, such as by heat or irradiation with light. When sufficient energy is imparted to the atom, ionization occurs and the atom releases one or more electrons.

Several types of electron emissions are known. Thermionic emission involves an electrically charged particle emitted by an incandescent substance (as in a vacuum tube or incandescent light bulb). Photoemission releases electrons from a material by means of energy supplied by incidence of radiation, especially light. Secondary emission occurs by bombardment of a substance with charged particles such as electrons or ions. Electron injection involves the emission from one solid to another. Finally, field emission refers to the emission of electrons due to an electric field.

In field emission (or cold emission), electrons under the influence of a strong electric field are liberated out of a substance (usually a metal or semiconductor) into a dielectric (usually a vacuum). The electrons "tunnel" through a potential barrier instead of escaping "over" it as in thermionics or photoemission. Field emission is therefore a quantum-mechanics phenomena with no classical analog. A more detailed discussion of the physics of field emission can be found in U.S. Pat. No. 4,663,559 to Christensen; Cade and Lee, "Vacuum Microelectronics", *GEC J. Res. Inc.*, Marconi Rev., 7(3), 129 (1990); and Cutler and Tsong, *Field Emission and Related Topics* (1978).

The shape of a field emitter affects its emission characteristics. Field emission is most easily obtained from sharply pointed needles or tips whose ends have been smoothed into a nearly hemispherical shape by heating. Tip radii as small as 100 nanometers have been reported.

As an electric field is applied, the electric lines of force diverge radially from the tip and the emitted electron trajectories initially follow these lines of force. Field emitters with such sharp features similar to a "Spindt cathode" have been previously invented. An overview of vacuum electronics and Spindt type cathodes is found in the November and December, 1989 issues of *IEEE Transactions of Electronic Devices.* Fabrication of such fine tips, however, normally requires extensive fabrication facilities to finely tailor the emitter into a conical shape. Further, it is difficult to build large area field emitters since the cone size is limited by the lithographic equipment. It is also difficult to perform fine feature lithography on large area substrates as required by flat panel display type applications. Thus, there is a need for a method of making field emitters with fine conical or pyramid shaped features without the use of lithography.

The electron affinity (also called work function) of the electron emitting surface or tip of a field emitter also affects emission characteristics. Electron affinity is the voltage (or energy) required to extract or emit electrons from a surface. The lower the electron affinity, the lower the voltage required to produce a particular amount of emission. If the electron affinity is negative then the surface shall spontaneously emit electrons until stopped by space charge, although the space charge can be overcome by applying a small voltage, e.g. 5 volts. Compared to the 10,000 to 20,000 volts normally required to achieve field emission from tungsten, a widely used field emitter, such small voltages are highly advantageous. There are several materials which exhibit negative electron affinity, but almost all of these materials are alkali metal based. Alkali metals are quite sensitive to atmospheric conditions and tend to decompose when exposed to air or moisture. Additionally, alkali metals have low melting points, typically below 1000° C., which may be unsuitable in certain applications.

For a full understanding of the prior art related to the present invention, certain attributes of diamond must also be discussed. Recently, it has been experimentally confirmed that the (111) surface of diamond crystal has an electron affinity of $-0.7+/-0.5$ electron volts, showing it to possess negative electron affinity. A common conception about diamonds is that they are very expensive to fabricate. This is not always the case, however. Newly invented plasma chemical vapor deposition processes appear to be promising ways to bring down the cost of producing high quality diamond thin films. For instance, high fidelity audio speakers with diamond thin films as vibrating cones are already commercially available. It should also be noted that diamond thin films cost far less than the high quality diamonds used in jewelry.

Diamond cold cathodes have been reported by Geis et al. in "Diamond Cold Cathode", *IEEE Electron Device Letters,* Vol. 12, No. 8, August 1991, pp. 456–459; and in "Diamond Cold Cathodes", *Applications of Diamond Films and Related Materials,* Tzeng et al. (Editors), Elsevier Science Publishers B. V., 1991, pp. 309–310. The diamond cold cathodes are formed by fabricating mesa-etched diodes using carbon ion implantation into p-type diamond substrates. Geis et al. indicate that the diamond can be doped either n- or p-type. In fact, several methods show promise for fabricating n-type diamond, such as bombarding the film with sodium, nitrogen or lithium during growth. However, in current practice it is extremely difficult to fabricate n-type diamond and efforts for n-type doping usually result in p-type diamond. Furthermore, p-type doping fails to take full advantage of the negative electron affinity effect, and pure or undoped diamond is insulating and normally charges up to prevent emission.

From the foregoing, there is a clear need for a thermodynamically stable material with negative electron affinity for use as a field emitter tip.

SUMMARY OF THE INVENTION

The present invention utilizes the extraordinary properties of diamond to provide a thermally stable negative electron affinity tip for a field emitter.

An object of the present invention is a process for fabricating large area field emitters with sharp submicron features without requiring photolithography.

Another object of the present invention is to provide a field emitter which requires only a relatively small voltage for field emission to occur.

Still another object of the present invention is a process for fabricating field emitters which uses relatively few steps.

A feature of the present invention is a field emitter composed of a conductive metal and a diamond emission tip with negative electron affinity in ohmic contact with and protruding above the conductive metal.

Another feature of the present invention is a method of fabricating a field emitter by coating a substrate with a diamond film having negative electron affinity and a top surface with spikes and valleys, depositing a conductive metal on the diamond film, and etching the metal to expose portions of the spikes without exposing the valleys, thereby forming diamond emission tips which protrude above the conductive metal.

A still further feature of the present invention is the use of an undoped insulating diamond emission tip which protrudes above a conductive metal by a height less than the mean free path of electrons in the tip thereby allowing the electrons to ballistically tunnel through the tip.

These and other objects, features and advantages of the present invention will be further described and more readily apparent from a review of the detailed description and preferred embodiments which follow.

BRIEF DESCRIPTION OF THE DRAWINGS

The following detailed description of the preferred embodiments can best be understood when read in conjunction with the following drawings, wherein.

DETAILED DESCRIPTION OF THE PREFERRED EMBODIMENTS

Figure 1A:
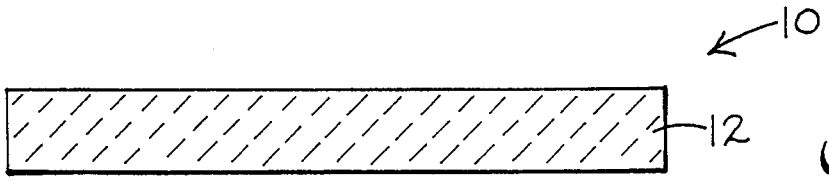
FIGS. 1A–1E show cross-sectional views of successive stages of fabricating a field emitter in accordance with one embodiment of the present invention.

Referring now to the drawings wherein depicted elements are not necessarily shown to scale and wherein like or similar elements are designated by the same reference numeral through the several views, and more particularly to FIGS. 1A–1E, there are shown successive cross-sectional views of a field emitter generally designated 10 according to a particularly preferred embodiment of the invention.

With reference now to FIG. 1A, a large area substrate 12 is provided. Substrate 12 is preferably glass and quartz, although other materials can be used, the requirement being they provide a base upon which a thin film of diamond can be deposited.

Figure 1B:
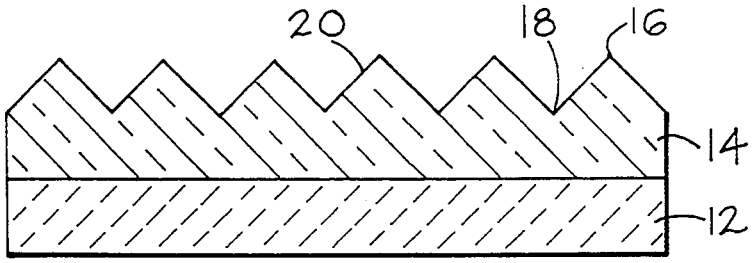

Referring now to FIG. 1B, a thin film of diamond 14 with negative electron affinity is coated on substrate 12. Diamond film 14 is preferably 500 to 5,000 angstroms thick which precludes the use of natural diamond. Further, diamond film 14 is undoped and insulating. The preferred method of coating the thin diamond film 14 is by chemical vapor deposition (CVD) but other methods such as sputtering, laser deposition and ion beam deposition are also suitable. The raw materials for diamond CVD are a hydrocarbon (usually methane ($CH_4$)) and hydrogen, and diamond CVD systems are similar to standard silicon oxide CVD systems. During CVD the combination of high temperature and plasma decomposes the hydrocarbon gas and activates high energy carbon atoms. The high energy carbon atoms bombard substrate 12 and form a carbon film thereon. In addition, the high energy bombardment causes the lattice configuration of the deposited carbon atoms to change. Various carbon lattice structures, while composed of the same material, form highly differing structures, such as carbon soot, graphite, and diamond. In the present invention, the deposited carbon atoms are bonded to four other carbon atoms. This lattice forms a diamond film on the substrate. Further details of CVD diamond films are described in the entire issue of the *Journal of Materials Research,* Vol. 5, No. 11, November 1990, which is incorporated herein by reference.

Diamond films can assume several orientations, such as (100), (110) and (111). The preferred orientation for diamond film 14 is (111) for several reasons. The (111) orientation provides the sharpest vertical features, shown as spikes 16 surrounded by valleys 18 on top surface 20 of diamond film 14. The (111) orientation also grows the fastest in the vertical direction. Moreover, it has been experimentally confirmed that the (111) surface of diamond has a negative electron affinity in the range of −1.2 to −0.2 electron volts. Nonetheless, other orientations can be used in the present invention as long as the diamond film retains negative electron affinity. The desired orientation of diamond can be obtained by applying the appropriate temperature during CVD.

The thermal conductivity of diamond film 14 is relatively high, for instance at least five times that of copper. However, since diamond film 14 contains more defects than natural diamond, the thermal conductivity of diamond film 14 is approximately less than half that of natural diamond.

Figure 1C:
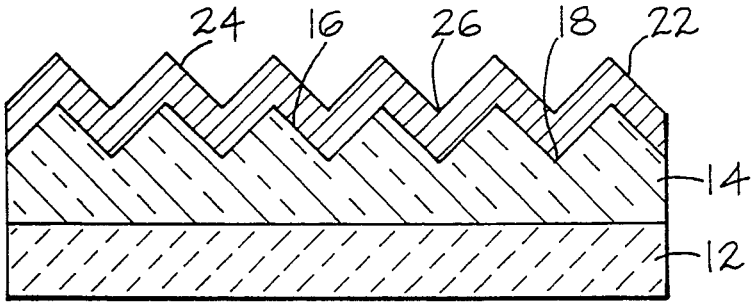

Referring now to FIG. 1C, the next step of the present invention is to deposit a conductive metal over the diamond film. Sputtering and evaporation are the preferred deposition techniques, with sputtering most preferred due to the low contamination and high integrity of the deposited metal. Further details of thin film technology are well known in the art; see, for instance, Maissel and Glang, *Handbook of Thin Film Technology,* 1983 Reissue, McGraw-Hill, New York, N.Y. Preferred metals are tungsten and titanium since they make good ohmic contact with diamond, with titanium most preferred. As may be seen, conductive metal 22 is deposited over diamond film 14 to form a metal layer thereon wherein conductive metal portions 24 cover spikes 16 and conductive metal portions 26 cover valleys 18. Conductive metal 22 preferably forms a uniform metal coating approximately 500 to 3,000 angstroms thick.

Figure 1D:
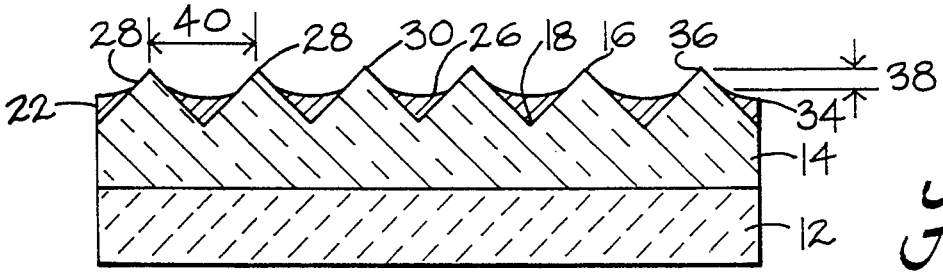

With reference now to FIG. 1D, an etch is applied to remove some but not all of conductive metal 22 in order to expose portions 28 of spikes 16 without exposing valleys 18. The exposed diamond portions 28 serve as raised field emission tips 30. The preferred etch is ion milling, although wet etching is also suitable, as is plasma etching or a combination thereof. In the present embodiment, two important features help assure diamond tips 30 are exposed while at least some metal 26 remains to cover valleys 18. First, the sharpness of spikes 16 compared to the flatness of valleys 18 allows metal 24 on spikes 16 to etch at a faster rate than metal 26 on valleys 18. This results in the non-etched metal having a substantially planar top surface 34. Second, conductive metal 22 has a faster etch rate than diamond 14 to help assure that the diamond will protrude above the conductive metal 22 after the etch is discontinued. For instance, when 500 electron volts of argon ions are used for sputter etching, the sputter yield (i.e., for an incoming atom, how many atoms are etched off) of diamond is 0.12 as compared to 0.51 for titanium and 1.18 for chromium.

When the etching is finished, emission tips 30 with peaks 36 protrude above non-etched metal top surface 34 by a height 38 less than the mean free path of electrons in diamond 14 to assure the desired field emission can later occur. That is, as long as the injection surface 34 is closer to the ejection point 36 than the mean free path of electrons in the emission tip 30, then statistically the electron emission shall occur due to the ballistic tunneling of electrons through the diamond. Applicant is not aware of the mean free path for electrons in CVD diamond, but estimates the distance to be in the range of 20 to 50 angstroms, which encompasses most materials, and almost certainly in the range of 10 to 100 angstroms. Therefore, vertical distance 38 is preferably no larger than 50 angstroms, more preferably no larger than approximately 20 angstroms, and most preferably no larger than approximately 10 angstroms. The horizontal space 40 between peaks 36 is preferably less than 1 micron, thus providing fine features with high emission tip density that are difficult to realize with photolithography based processes.

Figure 1E:
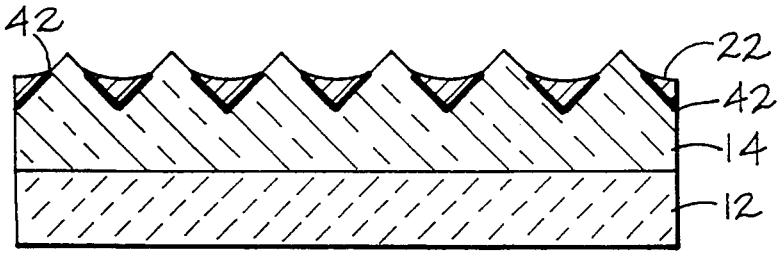

Referring now to FIG. 1E, it is critical that a low resistance connection between the conductive metal 22 and diamond film 14, commonly known as an "ohmic contact" be formed since higher contact resistance generates greater heat during field emission operation. An ohmic contact may arise during the step of depositing metal 22 on diamond 14, particularly if titanium or tungsten is sputter deposited. However, if an ohmic contact is not present, or if a better ohmic contact is desired, then an annealing step either before or after the etching step may be advantageous. For instance, field emitter 10 can be subjected to a 400° C. to 500° C. bake for approximately 10 minutes. This forms a 10 angstrom thick alloy 42 of diamond 14 and conductor 22 at the interface therebetween. Alloy 42 maintains a low resistance ohmic contact between diamond film 14 and conductor 22.

Figure 2:
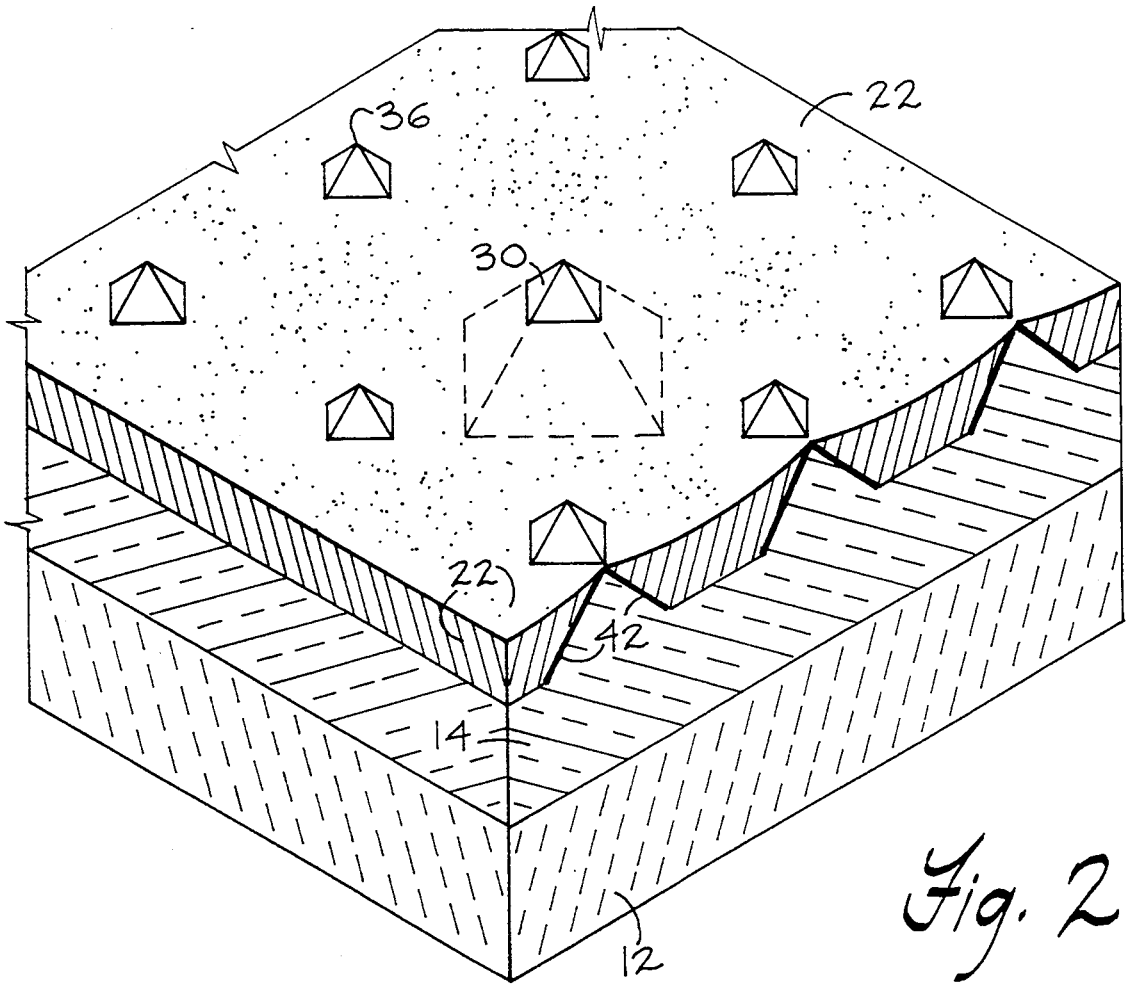
FIG. 2 shows an elevational perspective view of a field emitter of the present invention.

Referring now to FIG. 2, there is seen a perspective view of the field emitter 10 after fabrication is completed.

Other such possibilities should readily suggest themselves to persons skilled in the art. For example, a simpler technique would be to deposit a thin layer of diamond on top of a titanium layer and then anneal the layers at a high temperature to form an ohmic contact therebetween. However, this approach is not considered of practical importance since the number of diamond nucleation sites (and thus emission tips) would be difficult to control. In addition, only a generic structure of a field emitter has been shown herein. No attempt has been made to describe the various structures and devices in which such an emitter may be used.

The method of making the field emitter of the present invention is apparent from the foregoing description.

The present invention, therefore, is well adapted to carry out the objects and attain the ends and advantages mentioned, as well as others inherent therein. While presently preferred embodiments of the present invention have been described for the purpose of disclosure, numerous other changes in the details of construction, arrangement of parts, compositions and materials selection, and processing steps can be carried out without departing from the spirit of the present invention which is intended to be limited only by the scope of the appended claims.

What is claimed is:

1. A field emitter, comprising:

a conductive metal; and a diamond emission tip composed entirely of exposed diamond with negative electron affinity in contact with and protruding above a substantially planar top surface of said metal wherein said diamond emission tip extends from a diamond film beneath said conductive metal.

2. The field emitter of claim 1 with said diamond emission tip having a (111) orientation and an electron affinity in the range of approximately −1.2 to −0.2 electron volts.

3. The field emitter of claim 1 with said diamond emission tip being insulating and protruding a height above said conductive metal less than the mean free path of electrons in said diamond emission tip.

4. The field emitter of claim 3 with said height between approximately 10 to 100 angstroms.

5. The field emitter of claim 4 with said height between approximately 20 to 50 angstroms.

6. The field emitter of claim 1 with said conductive metal annealed to said diamond emission tip.

7. The field emitter of claim 6 with said diamond emission tip being insulating and protruding a height above said conductive metal less than the mean free path of electrons in said diamond emission tip.

8. The field emitter of claim 7 with a substrate beneath said conductive metal.

9. The field emitter of claim 8 with said conductive metal being titanium or tungsten.

10. A field emitter, comprising:

a substrate;

a conductive metal on said substrate; and a plurality of insulating diamond emission tips composed entirely of exposed diamond having an electron affinity in the range of approximately −1.2 to −0.2 electron volts annealed to and in ohmic contact with said conductive metal and protruding above a substantially planar top surface of said conductive metal by a height less than the mean free path of electrons in said diamond emission tips wherein said diamond emission tips extend from a diamond film beneath said conductive metal.

11. A field emitter, comprising:

a substrate;

a diamond film on said substrate, said diamond film having negative electron affinity and comprising a surface with spikes and valleys; and a conductive metal on said surface of said diamond film, said conductive metal covering said valleys and lower portions of said spikes wherein upper portions of said spikes protrude above a substantially planar top surface of said conductive metal to form diamond emission tips composed entirely of exposed diamond.

12. The field emitter of claim 11 with said substrate is selected from the group consisting of glass or quartz.

13. The field emitter of claim 11 with said diamond film being undoped and insulating.

14. The field emitter of claim 11 with said diamond film having a (111) orientation.

15. The field emitter of claim 11 with the thickness of said diamond film in the range of approximately 500 to 5,000 angstroms.

16. The field emitter of claim 11 with said diamond film having an electron affinity in the range of approximately −1.2 to −0.2 electron volts.

17. The field emitter of claim 11 with said diamond emission tips protruding a height above said conductive metal less than the mean free path of electrons in said diamond film thereby allowing electrons to ballistically tunnel through said diamond emission tips.

18. The field emitter of claim 17 with said height between approximately 10 to 100 angstroms.

19. The field emitter of claim 18 with said height between approximately 20 to 50 angstroms.

20. The field emitter of claim 11 with said diamond emission tips being horizontally spaced by less than 1 micron.

21. The field emitter of claim 11 with said conductive metal being titanium or tungsten.

22. The field emitter of claim 11 with said conductive metal in ohmic contact with said diamond film.

23. The field emitter of claim 11 with said conductive metal annealed to said diamond film.

24. The field emitter of claim 11 with an alloy of said conductive metal and said diamond film at the interface therebetween.

25. A field emitter, comprising:

a substrate;

a diamond film on said substrate, said diamond film having negative electron affinity and comprising a top surface with sharp vertical spikes surrounded by valleys; and a conductive metal in contact with and covering said valleys and lower portions of said spikes, wherein upper portions of said spikes protrude above a substantially planar top surface of said conductive metal to form diamond emission tips composed entirely of exposed diamond, said diamond emission tips having a height less than the mean free path of electrons in said diamond film thereby allowing electrons in said conductive metal to ballistically tunnel through said diamond emission tips.

26. The field emitter of claim 25 wherein said diamond film is undoped and insulating, and said diamond film is annealed to said conductive metal.

27. The filed emitter of claim 26 wherein said diamond film is in ohmic contact with said conductive metal.

28. A field emitter, comprising:

a substrate;

a diamond film on said substrate, said diamond film being undoped and insulating, having negative electron affinity and comprising a top surface composed of sharp vertical spikes consisting of upper and lower portions surrounded by valleys; and a conductive metal in ohmic contact with and covering said valleys and said lower portions of said spikes, wherein said upper portions of said spikes protrude above a substantially planer top surface of said conductive metal to form diamond emission tips composed entirely of exposed diamond, said diamond emission tips having a height less than the mean free path of electrons in said diamond film thereby allowing electrons in said conductive metal to ballistically tunnel through said diamond emission tips.

* * * * *